US006522970B2

(12) United States Patent
Kerner

(10) Patent No.: US 6,522,970 B2
(45) Date of Patent: Feb. 18, 2003

(54) METHOD FOR DETERMINING THE TRAFFIC STATE IN A TRAFFIC NETWORK WITH EFFECTIVE BOTTLENECKS

(75) Inventor: Boris Kerner, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/917,270

(22) Filed: Jul. 30, 2001

(65) Prior Publication Data

US 2002/0045985 A1 Apr. 18, 2002

(30) Foreign Application Priority Data

Jul. 28, 2000 (DE) ..... 100 36 789

(51) Int. Cl.[7] ..... G06G 7/76; G08G 1/01
(52) U.S. Cl. ..... 701/117; 701/118
(58) Field of Search ..... 701/117, 118; 340/905, 988, 991; 180/167

(56) References Cited

U.S. PATENT DOCUMENTS 5,812,069 A 9/1998 Albrecht
5,999,877 A * 12/1999 Takahashi et al. ..... 340/905
6,236,932 B1 5/2001 Fastenrath

FOREIGN PATENT DOCUMENTS

| | | |
|---|---|---|
| DE | 19737440 | 8/1998 |
| DE | 19526148 | 9/1998 |
| DE | 19725556 | 12/1998 |
| DE | 19753034 | 6/1999 |
| DE | 19944075 | 3/2001 |
| DE | 19754483 | 5/2001 |
| EP | 0902405 | 3/1999 |

* cited by examiner

*Primary Examiner*—William A. Cuchlinski, Jr.
*Assistant Examiner*—Olga Hernandez
(74) *Attorney, Agent, or Firm*—Crowell & Moring LLP

(57) ABSTRACT

A method for determining the traffic state in a traffic network with effective bottlenecks with a classification at least into the "freely flowing traffic", "synchronized traffic" and "moving widespread congestion" state phases and into patterns of dense traffic upstream of effective bottlenecks. FCD traffic data which includes information relating to the location and the speed of the vehicle is recorded at time intervals for a respective route section, and by reference to the information it is determined whether an effective bottleneck is present. If this is the case, from the current FCD traffic data, a pattern of dense traffic, which fits it, is continuously determined as a currently present pattern of dense traffic.

11 Claims, 4 Drawing Sheets

METHOD FOR DETERMINING THE TRAFFIC STATE IN A TRAFFIC NETWORK WITH EFFECTIVE BOTTLENECKS

BACKGROUND AND SUMMARY OF THE INVENTION

This application claims the priority of German Application No. 100 36 789.5, filed Jul. 28, 2000, the disclosure of which is expressly incorporated by reference herein.

The invention relates to a method for determining the traffic state in a traffic network with effective bottlenecks.

A traffic state determining method of this type is described in the German Patent Application 199 44 075.1 by the applicant with earlier priority, the contents of which are entirely incorporated herein by reference.

Methods for monitoring and forecasting the traffic state on, for example, road traffic networks are known in different forms and are particularly also of interest for various telematic applications in vehicles. An objective of these methods is to acquire an at least qualitative description of the traffic state at a respective measuring point and its surroundings from traffic data recorded at traffic measuring points. Possible measuring points in such a case are both measuring points which are installed in a stationary fashion and mobile measuring points, the latter being in particular in the form of measuring vehicles, referred to as "floating cars", which move along in the traffic.

In order to arrive at a qualitative description of the traffic state it is known to classify the latter into various, individually identifiable state phases, specifically into the "freely flowing traffic", "synchronized traffic" and "congestion" phases, it being possible for the "synchronized traffic" phase to contain what is referred to as "pinch regions" in which vehicles can travel only at very low speeds and brief congestion states form spontaneously and can migrate and grow upstream so that persistent congestion states can develop from them. These congestion states then form regions of "wide moving jam"; see the above German Patent Application 199 44 075.1 with earlier priority from the same company, and the literature cited there, on this subject area of state phases.

The term "effective bottlenecks" refers here to points in the traffic network at which given an appropriate traffic volume a boundary or edge which persists on a localized basis over a specific time period forms between downstream freely flowing traffic and upstream synchronized traffic. The formation of such effective bottlenecks is determined frequently, if not exclusively, by corresponding topographic conditions of the road network, such as bottlenecks at which the number of useable lanes is reduced, lanes entering a road, a bend, a positive incline, a negative incline, splitting up of a carriageway into a plurality of carriageways or exits. Effective bottlenecks can, however, also be caused by, for example, temporary traffic disruption such as bottlenecks which move slowly in comparison to the average vehicle speed in freely flowing traffic, for example roadworks vehicles, or by road accidents.

As is described in detail in the German Patent Application 199 44 075.1 with earlier priority, the traffic state upstream of effective bottlenecks can be classified into various patterns of dense traffic which are composed of a typical sequence of the aforementioned individually identifiable dynamic state phases or regions which are formed therefrom. Thus, at first a region of synchronized traffic is typically formed upstream of an effective bottleneck, it being possible for the upstream by a pinch region ahead of which a region of widespread moving congestion can form. Associated with each such pattern of dense traffic upstream of an effective bottleneck is a corresponding profile of the traffic parameters, such as the time/location profile of the vehicle speed within the pattern, which are taken into account for determining the state phases. If a pattern of a first effective bottleneck reaches the location of a second effective bottleneck, what is referred to as an extensive pattern of dense traffic, which includes a plurality of effective bottlenecks, is formed. Such extensive patterns have a typical sequence of different traffic state phases and associated traffic parameter profiles.

In so far as effective bottlenecks are determined by the properties of the traffic route network itself, such as entries, exits, route sections with a positive incline, bends, splitting up of carriageways and confluences of carriageways, the local positions of such topographic route features can be stored without difficulty at the vehicle end or in a traffic control centre, for example together with other route network data in the form of what is referred to as a digital route network map.

It is known that stored traffic data which is required empirically or in other ways can be used to forecast traffic states on the traffic network, i.e. predicted for a future time. A known forecasting method is referred to as load curve forecasting in which currently measured traffic data is compared with stored load curve traffic data and a load curve which fits best is determined therefrom and used as the basis for estimating the future traffic state, see for example German Laid-open Publication DE 197 53 034 A1. Further traffic state forecasting methods which may also make use, inter aila, of FCD (floating car data) traffic data are described in German Laid-open Publications DE 197 25 556 A1, DE 197 37 440 A1, DE 197 54 483 A1 and EP 0 902 405 A2, and in the Patent DE 195 26 148 C2.

The invention is based on the technical problem of making available a method of the type mentioned at the beginning with which the current traffic state can be determined comparatively reliably, specifically also in the region upstream of effective bottlenecks, so that, on this basis reliable traffic forecasts are also possible, when necessary.

The invention solves this problem by providing a method characterized in particular by the fact that currently acquired FCD traffic data is used to detect patterns of dense traffic at effective bottlenecks. To do this, the FCD traffic data includes at least information relating to the location and the speed, preferably relating to the time-dependent and location-dependent speed profile, of the respective traffic data-recording FCD vehicle, the FCD traffic data being acquired for a respective route section by an FCD vehicle at specific time intervals and/or by a plurality of FCD vehicles travelling along this route section at time intervals.

By reference to the FCD traffic data which is recorded by the FCD vehicle or vehicles, it is then determined for the respective route section whether an effective bottleneck is present, i.e. a boundary or edge remaining localized over a certain time period between downstream freely flowing traffic and upstream synchronized traffic. This can be detected, for example, from the fact that the vehicle speeds reported by the FCD vehicle or vehicles in the respective route section upstream of the effective bottleneck drop below an average speed value which is typical of the state of freely flowing traffic.

If an effective bottleneck is detected in this way, the currently recorded FCD traffic data continues to be evaluated to determine whether it is assigned a pattern of dense traffic which fits it upstream of the effective bottleneck. This is then considered as the currently present pattern of dense traffic at the respective effective bottleneck. In this way, the current traffic state in this region is determined, which can be used, for example, for a traffic forecast by means of a load curve forecast or some other forecasting technique.

According to another aspect, a detection is made by using the currently recorded FCD traffic data to determine whether a region of "wide moving jam" has broken away from its pattern of dense traffic at whose upstream end it has come about, which is the case if the reported vehicle speeds downstream of this region do not behave as in the pinch region, but rather, for example, as in the region of freely flowing traffic.

Another method according to the present invention permits the specific detection of entry-like or exit-like effective bottlenecks by virtue of the fact that the reported vehicle speeds rise over or before the actual location of the corresponding change in the route topography which is present, for example, as information stored in a digital route map. Another method permits the detection of temporary bottlenecks which are not caused topographically but, for example, are due to road accidents.

Another aspect makes it possible to detect extended patterns of dense traffic in which, in each case, two or more effective bottlenecks are involved.

Another object of the invention is to specifically permit the detection of the boundary between the region of "wide moving jams" and the "pinch region" in a pattern of dense traffic. Analogously, another developed method permits the detection of the boundary between the "pinch region" and the region of "synchronized traffic" in a pattern of dense traffic, and a preferred method of the present invention allows for the detection of the boundary between the region of "freely flowing traffic" and the "pinch region".

Another aspect of the present invention permits the current density of the traffic to be determined from the recorded FCD traffic data for the various detected traffic state phases comprising "freely flowing traffic", "synchronized traffic" and "pinch region" by reference to associated travel times derived from the FCD traffic data. In an analogous fashion, the flow rate is able to be determined for detected regions of congestion.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
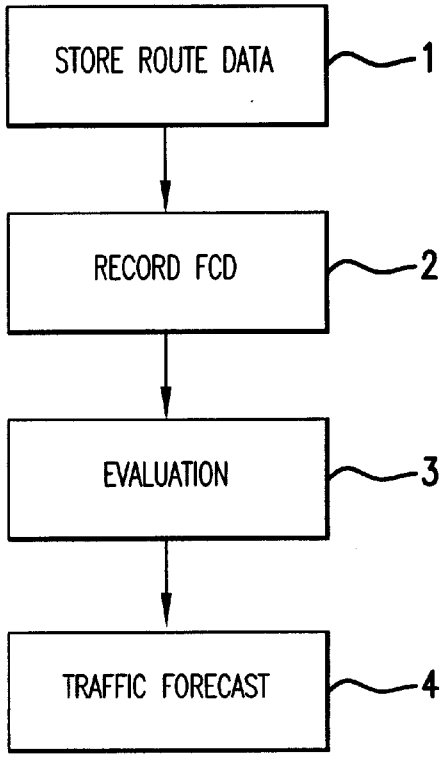
FIG. 1 shows a flowchart of a method for determining traffic states on the basis of detected patterns of dense traffic at effective bottlenecks.

FIG. 1 shows a schematic view of the sequence of the present traffic state determining method. In a first step 1, data relating to the locations of topographic route features which can lead to the formation of effective bottlenecks are recorded in advance for a traffic network under consideration and stored in a corresponding data base, preferably together with further data in the form of a digital route network map. This can then be updated in a vehicle-mounted memory and/or in a computer of a traffic control centre. Furthermore, at the vehicle end or at the control centre end suitable components are implemented with which current FCD traffic data can be received from corresponding FCD vehicles and evaluated, in particular to the effect that the presence of effective bottlenecks and patterns of dense traffic at a given moment upstream thereof is concluded from current FCD traffic data. This will be explained in detail below. Moreover, the evaluation of the FCD traffic data can be carried out according to one of the conventional methods. The evaluation can then be used in particular to produce automatic travel time forecasts.

During ongoing operation of the traffic state determining method, in a corresponding step 2 FCD traffic data is received from FCD vehicles which are travelling on the different sections of the traffic network, i.e. are moving along in the traffic. The FCD traffic data includes here, in particular, data relating to the instantaneous speed and the instantaneous location of the respective FCD vehicle and, depending on the application, further conventional FCD data contents. The recorded FCD traffic data is transmitted to the evaluating location which can be positioned, as stated, in a respective vehicle or in a stationary traffic control center. In the evaluating location, the suitably recorded FCD traffic data is then evaluated in order to determine the current traffic state, in particular with respect to the presence of effective bottlenecks and of patterns of dense traffic at effective bottlenecks. This evaluation constitutes method step 3 which is of primary interest. This is described in more detail below. Moreover, when necessary the traffic state can be determined at other locations of the traffic network according to one of the customary procedures. The current traffic state which is determined, and in particular the detected, currently present patterns of dense traffic at effective bottlenecks, can then form the basis for traffic forecasts, as seen in step 4.

The evaluation of the recorded FCD traffic data starts by determining whether the vehicle speeds, which are continuously recorded for successive positions on the relevant route section by one or more FCD vehicles which are travelling one behind the other at specific time intervals on the respective route section, or an average vehicle speed at the respective measurement location, which are acquired from said recorded vehicle speeds, drop below a predefinable threshold value, which is representative of a traffic disruption event. These values allow for detection of whether a state of non-freely flowing traffic is present there, i.e. congestion or a region of "wide moving jams" or a region of "synchronized traffic" or a "pinch region". As stated, this traffic disruption detection is already possible by reference to the data of a single FCD vehicle. If the data of a plurality of FCD vehicles which are travelling one behind the other on the same route section is present, it is, however, possible to improve the accuracy and reliability of the detection, in particular the traffic dynamic and the change in average travel times and the traffic flow behaviour can also then be detected.

If, in this way, a state of non-freely flowing traffic has been detected in a region of a respective route section, the FCD traffic data of this region is further analysed to determine whether this state is based on an effective bottleneck. An indication of this state occurs when the downstream end of the detected state of non-freely flowing traffic remains locally fixed, which points to the presence of an effective bottleneck. Furthermore, from the current FCD traffic data, in particular the corresponding traffic parameter profile, specifically the speed profile, a fitting, associated pattern of dense traffic is determined at the vehicle end and/or control centre end. The pattern of dense traffic which is determined in such a way is then considered as the currently present one and used for the further applications. These applications comprise, depending on requirements, a reconstruction of the traffic position for subregions or the entire traffic network and/or a traffic forecast for the same and/or a selection of a most suitable load curve from a corresponding load curve data base for performing traffic forecasting and/or producing an improved load curve forecast for the traffic network.

Advantageous detailed measures and refinements of this procedure for detecting patterns of dense traffic at effective bottlenecks by reference to FCD traffic data are explained in more detail below in conjunction with FIGS. 2 to 6.

One measure consists in evaluating the FCD speed data of one or more FCD vehicles for the detection, in order to determine whether a region of "wide moving jams" has broken off from the upstream end of a pattern of dense traffic where such regions typically come about and develop, or whether it is still associated with the pattern. In the former case, the downstream edge $F_{St,GS}$ of the region of "wide moving jams" in the upstream direction is removed from the downstream end of the pattern of dense traffic associated with an effective bottleneck at a location $X_{S,F}$, as is the case in the schematic situation diagram in FIG. 2. In the latter case, the upstream edge $F_{St,GS}$ of the region of "wide moving jams" represents the boundary with an adjoining downstream "pinch region" as illustrated in the situation diagram in FIG. 4.

The location of the boundary $F_{St,GS}$ between the region of "wide moving jams" and the "pinch region" in a pattern of dense traffic can be detected by reference to FCD speed data from, for example, the fact that starting from this boundary $F_{St,GS}$, as a result of the "pinch region" being reached, relatively severe and brief reductions in speed, in comparison with the previous speed values upstream thereof, almost to a standstill for typically approximately 1 min to 2 min alternate with intermediate vehicle movements during which the vehicle speed typically alternates in a range of approximately 20 km/h to 40 km/h for typical time periods of approximately 3 min to 7 min for pinch regions. If, on the other hand, after it has been detected that a region of "wide moving jams" has been travelled through, no such typical speed profile is measured, but rather, for example, one which is typical for freely flowing traffic, it is concluded that the region of "wide moving jams" has broken off, as in the case of FIG. 2.

Furthermore, the present method permits a decision to be made by reference to FCD traffic data to determine whether a localized effective bottleneck is an entry-like or an exit-like effective bottleneck such as is explained below with reference to FIG. 3.

Figure 3:
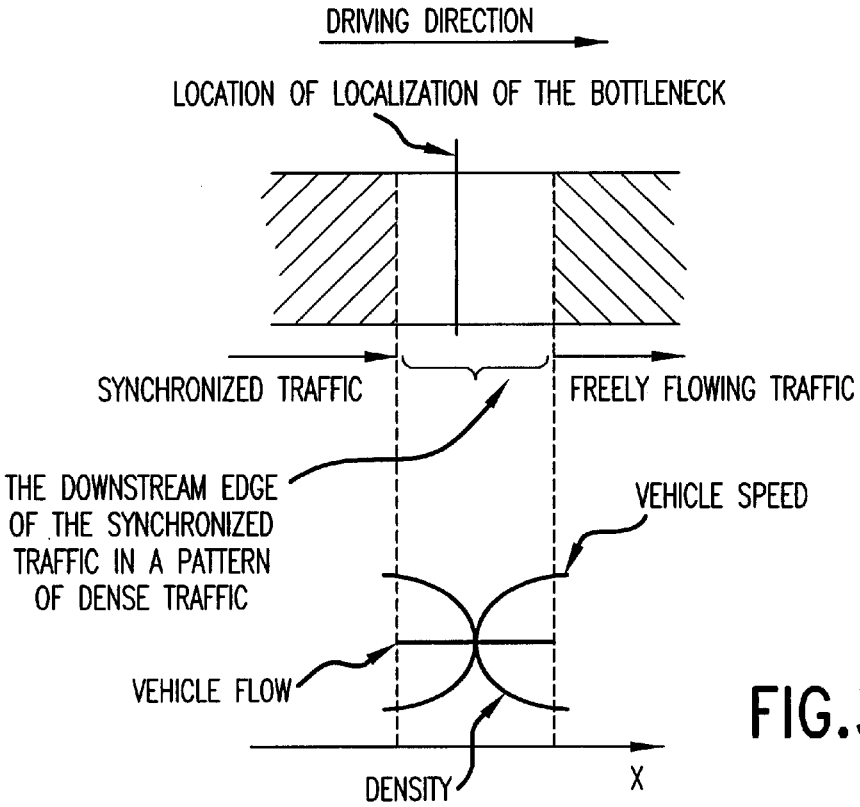
FIG. 3 shows a schematic view explaining the localization, according to the method, of an effective bottleneck.
Figure 2:
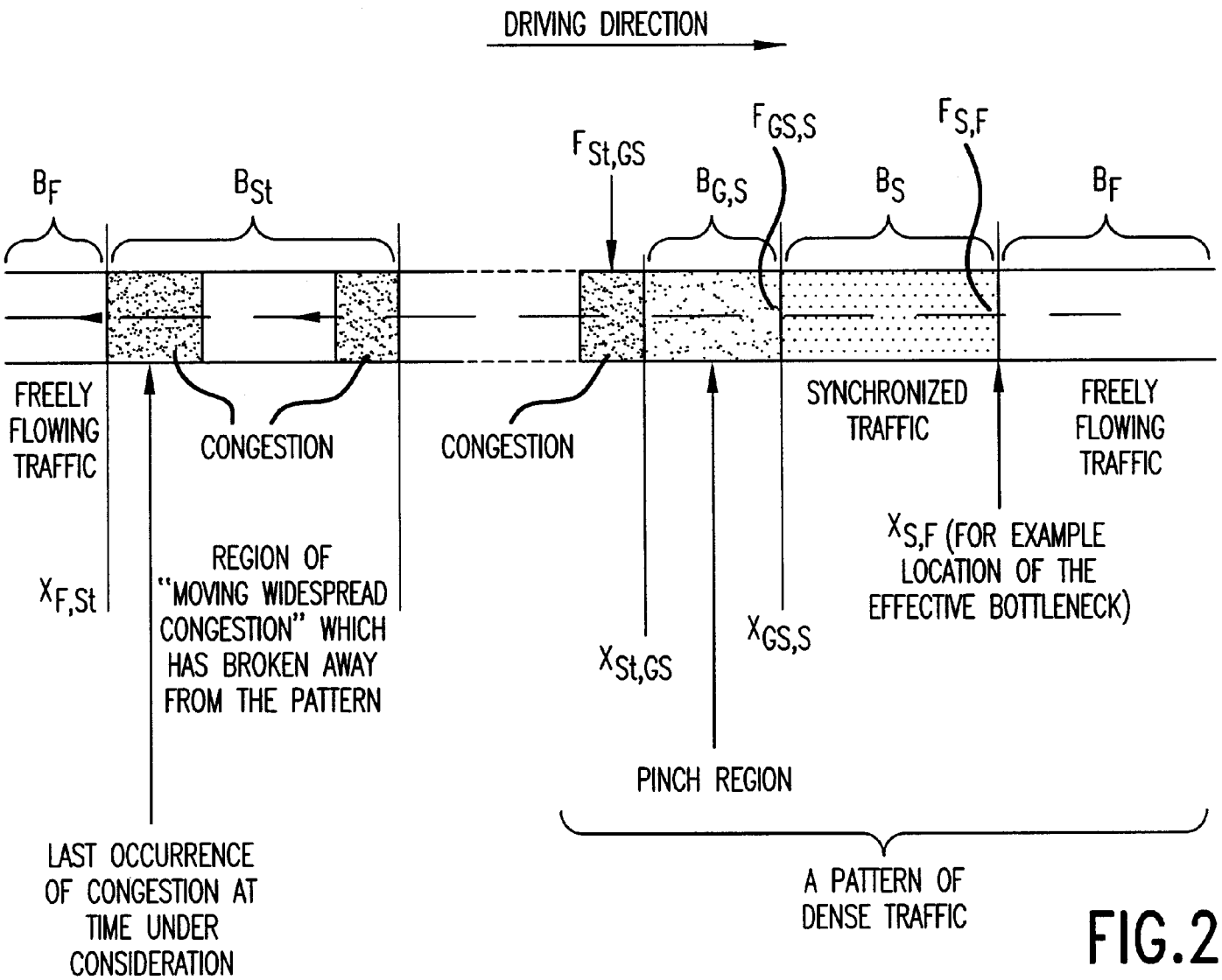
FIG. 2 shows a schematic view of a route section with an effective bottleneck and associated pattern of dense traffic as well as a region of "wide moving jams" which has broken off.

FIG. 3 shows in the upper part a schematic view of the surroundings of an effective bottleneck and in the lower part a diagrammatic view of the associated typical location-dependent profile of the vehicle flow, vehicle density and vehicle speed. As is clear therefrom, in the actual region of the effective bottleneck the vehicle speed continuously rises from the lower value in the upstream region of synchronized traffic to the higher average speed value in the region of freely flowing traffic, while conversely the vehicle density continuously decreases correspondingly. A vertical bar in the upper part of the diagram indicates the point at which the effective bottleneck is actually located.

On the graphic representation it is clear that in cases in which the effective bottleneck is based on an entry the average vehicle speed only rises significantly behind the actual entry point. This case is assumed in FIG. 3. In contrast thereto in a case in which the effective bottleneck is an exit-like bottleneck, i.e. is based on an exit or a branch of a motorway, the average vehicle speed begins to rise noticeably even before the actual exit location. By utilizing this fact, the FCD speeds measured in the region before and after an effective bottleneck are evaluated to determine whether the average vehicle speed profile associated with them points, over the region of the bottleneck, to a noticeable rise in speed already before or only after the actual entry or exit point. In the latter case, the presence of an entry or of an entry-like effective bottleneck is concluded, in the former case an exit or an exit-like effective bottleneck. A rise in speed is evaluated as being relevant in this respect if the speed of one or more FCD vehicles which was low within the pattern of dense traffic in comparison with a predefined typical value for freely flowing traffic rises again and exceeds a predefined threshold value which is typical for the phase transition from synchronized to freely flowing traffic, the location of the rise in speed having to be located within a predefined maximum distance before the exit point or behind the entry point. If the speed data of a plurality of FCD vehicles which pass the effective bottleneck one behind the other at time intervals are used for this, the speed data is to be related, within a predefined tolerance, to the same location which represents the point of localization of the effective bottleneck. The variation over time of the rise in speed must then be the same within a predefined tolerance for the various FCD vehicles.

Furthermore, the present method permits effective bottlenecks to be detected which are not due to recorded route topography features, i.e. stored in advance, but rather, for example, are caused temporarily by road accidents on motorways. The presence of such an effective bottleneck is concluded if the measured FCD speed data has indicated a pattern of dense traffic and after the vehicle leaves this region of dense traffic the FCD speeds rise again to an average speed value which is low compared with a predefined threshold value which is typical for freely flowing traffic and exceed a predefined threshold value which is typical for a phase transition from synchronized to freely flowing traffic and which in this case is selected to be larger than the corresponding threshold value for the distinction described above between effective bottlenecks which exist at entries and exits. In this case, an effective, non-recorded bottleneck is assumed if the location of the rise in speed lies outside the surroundings of the detected, known locations of the respective changes in route topography.

The present method also permits a decision to be made as to whether a detected pattern of dense traffic is an individual pattern or an extended pattern. The criterion for this decision is the detection as to whether the region of synchronized traffic or pinch region has expanded beyond the location of the localization of an associated effective bottleneck. This can be detected by reference to the measured FCD speeds from the fact that no significant rise in the average vehicle speed occurs downstream of the effective bottleneck forming the downstream edge of the region of synchronized traffic, which indicates that a pattern of dense traffic of a downstream effective bottleneck has reached, or extended beyond, this downstream effective bottleneck. From the evaluated FCD speed profile it is also possible to detect how many effective bottlenecks are covered by such an extended pattern. To do this, it is detected by reference to the FCD speed data over how many effective bottlenecks a region of synchronized traffic and/or a pinch region or any desired uninterrupted sequence of regions of wide moving jams, pinch regions and regions synchronized traffic extends.

Figure 4:
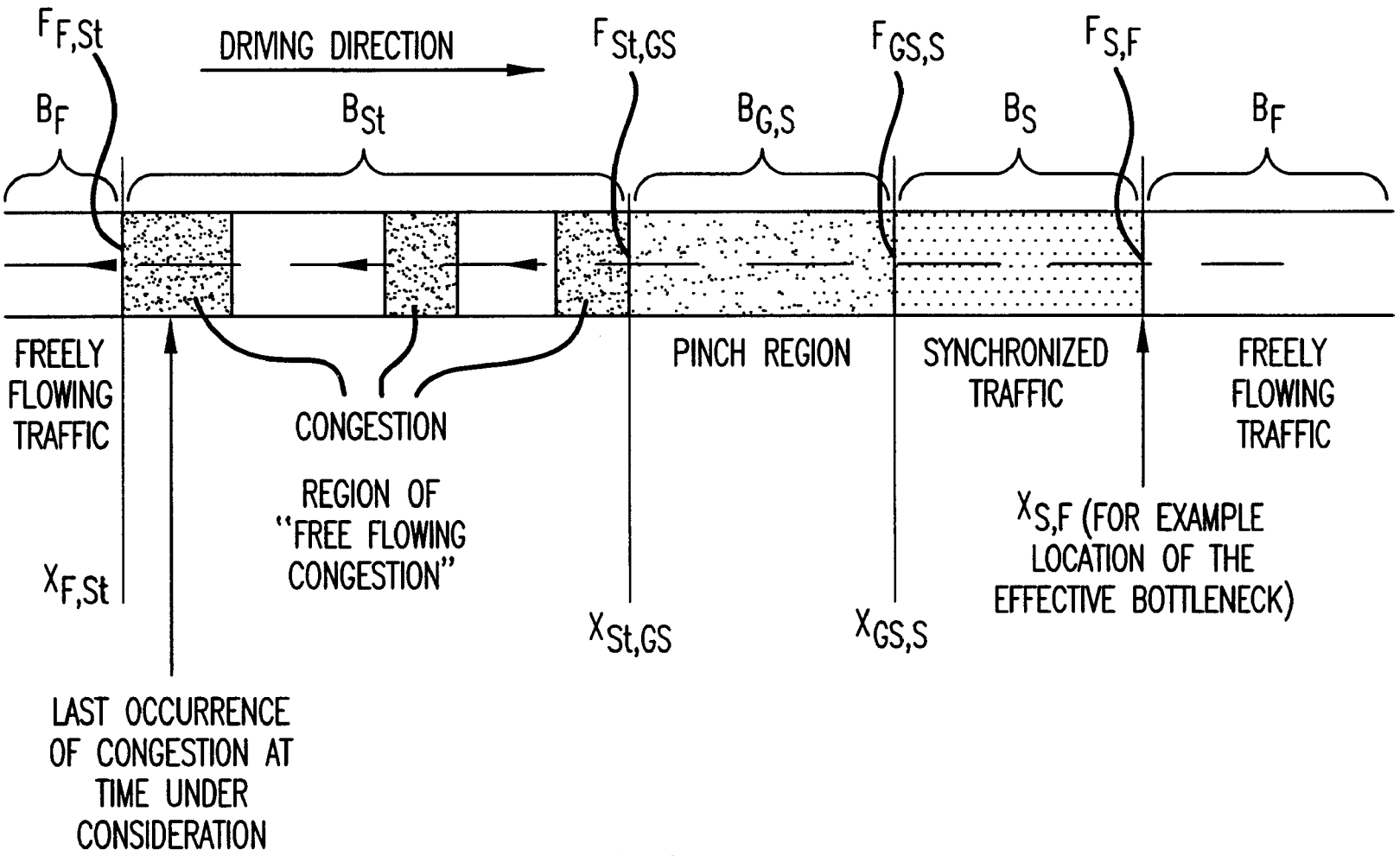
FIG. 4 shows a schematic view corresponding to FIG. 2, but with a region of "moving widespread congestion" which has not broken off.
Figure 5:
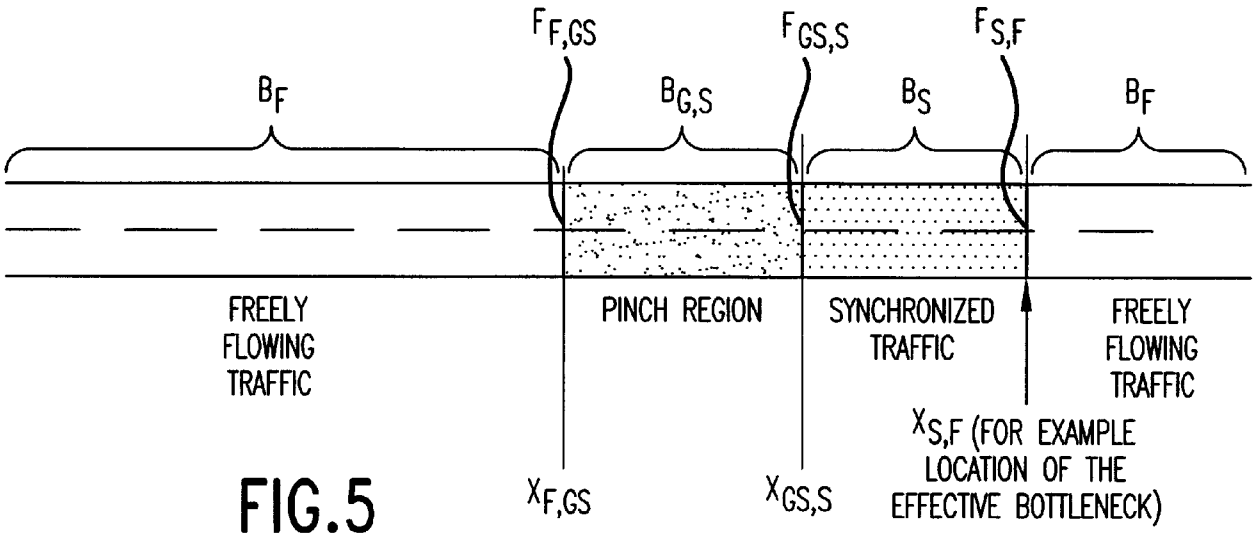
FIG. 5 shows a view corresponding to FIG. 4, but for a reduced pattern of dense traffic without the region of "wide moving jams

Furthermore, by reference to the recorded FCD speed data it is possible to determine the location of the boundary or edge $F_{GS,S}$ between a pinch region and a region of synchronized traffic which adjoins the pinch region downstream in a pattern of dense traffic. Such a boundary $F_{GS,S}$ is present both for a complete pattern of dense traffic with a region $B_S$ of synchronized traffic, a pinch region $B_{GS}$ which adjoins upstream and a region $B_{St}$ of wide moving jams which adjoins upstream, such is as shown in FIG. 4, and for a reduced pattern of dense traffic which is shown in FIG. 5 and in which the region of wide moving jams is absent. The location of the edge $F_{GS,S}$ is determined as that location starting from which the typical speed profile of the pinch region, which is explained above, merges with a speed profile which is typical of synchronized traffic, after which the average vehicle speed lies in the region of synchronized traffic between a typical minimum speed for synchronized traffic, which is possible without the pinch phenomena, and a typical minimum speed for freely flowing traffic.

Figure 6:
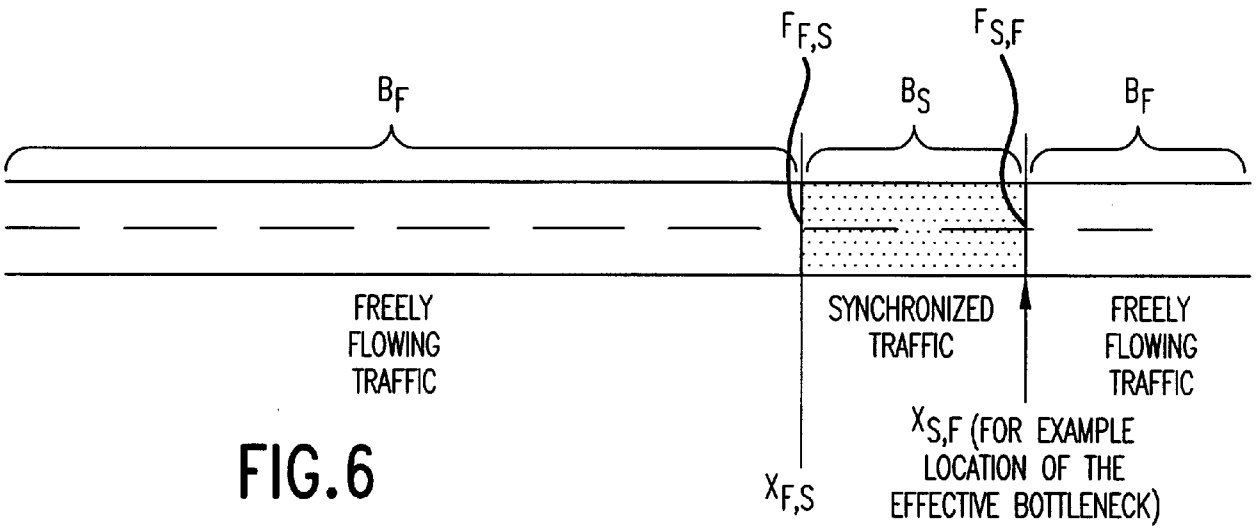
" and FIG. 6 shows a schematic view corresponding to FIG. 5, but for a further reduced pattern of dense traffic without the "pinch region".

Analogously, by reference to the measured FCD speed data it is possible to determine the location of a boundary or edge $F_{F,s}$ between the region of synchronized traffic $B_S$ and a region of freely flowing traffic $B_F$ which adjoins upstream for a reduced pattern of dense traffic, which is illustrated in FIG. 6, and is composed only of the region of synchronized traffic upstream of an effective bottleneck which is adjoined downstream again by a region of freely flowing traffic, the downstream edge $F_{S,F}$ of the region of synchronized traffic $B_S$ corresponding, as always, to the location $X_{S,F}$ of the effective bottleneck. The location starting from which the average vehicle speed which is acquired by reference to the FCD speed data and which previously corresponded to the typical value for freely flowing traffic drops below the typical minimum value for freely flowing traffic and subsequently lies in the typical speed range for synchronized traffic, i.e. between the typical minimum speed of synchronized traffic and the typical minimum speed for freely flowing traffic is determined as the location of the edge $F_{F,S}$ between freely flowing traffic and downstream synchronized traffic.

Furthermore, the present method permits the flow rate $q^{(j)}$ for the ,various route edges j also to be determined specifically for motorways of a traffic network. To do this, reference is first made to the recorded FCD traffic data. The travel times $t_{tr}^{(j)}$ of a plurality of FCD vehicles which travel along the route edge j at various times are simply determined by reference to the corresponding location and time data and used, together with their distance _L to be determined from this data, on the route edge j for determining flow rate. This is carried out for the various traffic state phases of "freely flowing traffic", "synchronized traffic", "pinch region" and "congestion" in a suitably adapted fashion as follows.

In regions of freely flowing traffic, the flow rate $q^{(j)}$ is determined by comparing the travel times $t_{tr}^{(j)}$ and distances _L which are determined as stated above, by reference to a function $Q_{free}^{(j)}$ which is predefined as a function of these parameters and which yields the typical flow rate, dependent on these parameters, in freely flowing traffic on a route edge j, in particular a motorway of the traffic network, i.e. the current flow rate $q^{(j)}$ is obtained as $$q^{(j)}=Q_{free}^{(j)}(t_{er}^{(j)},_L) \tag{1}$$

For regions of synchronized traffic a typical predefined functional dependence $Q_{synch}^{(j)}(T,L)$ of the flow rate is also used as a function of the travel time T and the associated distance L between which the corresponding travel time has been measured by the respective FCD vehicle in order, by reference to the current measured travel time $t_{tr}^{(j)}$ and the current interval _L between FCD vehicles, to determine the current flow rate $q^{(j)}$ in synchronized traffic by means of the relationship $$q^{(j)}=Q_{sycnh}^{(j)}(t_{tr}^{(j)},_L) \tag{2}$$

In analogous fashion, the flow rate $q^{(j)}$ for a respective route edge j is determined in pinch regions by means of the relationship $$q^{(j)}=Q_{gest}^{(j)}(t_{tr}^{(j)},_L), \tag{3}$$

$Q_{gest}^{(j)}(T,L)$ representing a predefined function which specifies the typical dependence of the flow rate on the travel times and intervals between which the respective travel time has been measured by means of FCD vehicles, in pinch regions.

In equation 2 above, the travel time corresponds to the driving time of one or more FCD vehicles between the boundary $F_{GS,s}$ of a pinch region and the synchronized traffic, and the boundary $F_{S,F}$ between synchronized traffic and freely flowing traffic if a pattern of dense traffic of the type in FIG. 4 or 5 is present, and the corresponding driving time between the boundary $F_{F,S}$ between freely flowing traffic and synchronized traffic, and the boundary $F_{S,F}$ between synchronized and freely flowing traffic in the case of a pattern of dense traffic according to FIG. 6. In the equation 3 above, the travel time corresponds to the driving time of one or more FCD vehicles between the boundaries $F_{St,Gs}$ and $F_{GS,s}$ in the case of the pattern of dense traffic in FIG. 4, and the driving time between the limits $F_{F,GS}$ and $F_{GS;s}$ in the case of a pattern of dense traffic according to FIG. 5. Furthermore, the distance DL which is to be used is in each case the length of the region of synchronized traffic $B_S$ or pinch region $B_{GS}$.

Further flow rate information can be derived from the difference $_t_{tr}^{(j)}$ between the travel times of FCD vehicles which travel along the respective route edge j of the traffic network at a time interval $_t^{(t)}$. These differences $_t_{tr}^{(j)}$ of average FCD travel times can be used specifically to determine the flow rate $q_{in}^{(j)}$ of vehicles which travel into congestion, specifically according to the relationship $$q_{in}^{(j)}=[1+_t_{tr}^{(j)}/_t^{(j)}]q_{out}^{(j)} \tag{4}$$

Here, $q_{out}^{(j)}$ designates a characteristic predefined flow rate of vehicles leaving the congestion, while $_t_{tr}^{(j)}=t_{tr,2}^{(j)}-t_{tr,1}^{(j)}$ yields the difference between the waiting time of a second FCD vehicle which has travelled into the congestion later and the waiting time of a first FCD vehicle which has travelled into the congestion earlier.

If the number of lanes is not constant along the route edge j, the above equations 1 to 4 are each provided on the right-hand side of the equation with an additional lane factor n/m in order to obtain cross-sectional values of the flow rate taking into account the number of lanes, n designating the number of lanes at the start of the route section in question and m the number of lanes at the end of the route section, and it being assumed that the number of lanes does not change during the time period for which the evaluated FCD traffic data are considered.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for determining the traffic state in a traffic network with one or more effective bottlenecks, in particular in a road traffic network, comprising the steps of:

classifying the traffic state, taking into account recorded traffic data, into a plurality of state phases which comprise at least the "freely flowing traffic", "synchronized traffic" and "wide moving jam" state phases, and classifying the traffic state upstream of a respective effective bottleneck of the traffic network, when an edge ($F_{S,P}$), fixed at said bottleneck, is determined between downstream freely flowing traffic ($B_S$) and upstream synchronized traffic ($B_S$), as a pattern of dense traffic which is representative of the respective effective bottleneck and which includes one or more different regions ($B_S$, $B_{GS}$, $B_{St}$) of different state phase composition which are in succession in the upstream direction and an associated profile of the traffic parameters which are taken into account for the state phase determination, wherein FCD (floating car data) traffic data which comprises information relating to the location and the speed of the vehicle is recorded at time intervals by one or more vehicles moving in the traffic, and determining, from the FCD traffic data recorded for a respective track section, whether an effective bottleneck is present, and if said effective bottleneck is present, determining a pattern of dense traffic which fits the current FCD traffic data as a currently present pattern of dense traffic at the effective bottleneck.

2. The method according to claim 1, further comprising the step of determining, by reference to the recorded FCD traffic data, whether a region of "moving widespread congestion" forms the upstream part of a detected pattern of dense traffic or has moved upstream from it.

3. The method according to claim 1, further comprising the step of determining, by reference to the FCD traffic data whether the traffic speed upstream of a pattern of dense traffic rises again from a speed value which is lower than a speed value which is representative of freely flowing traffic, and exceeds a threshold value which is representative of a phase transition from synchronized traffic to freely flowing traffic, and whether in this case the location of the rise in speed lies downstream of a localization point of an associated change in route topography, from which the presence of entry-like effective bottleneck is concluded.

4. The method as claimed in claim 1, further comprising the step of determining, by reference to the FCD traffic data, whether the vehicle speed rises again downstream of a pattern of dense traffic from a speed value which is lower than a speed value which is representative of freely flowing traffic, and exceeds a threshold value which is representative of a phase transition from synchronized traffic to freely flowing traffic, and whether in this case the location of the rise in speed lies before a localization point of an associated change in route topography, from which the presence of an exit-like effective bottleneck is concluded.

5. The method according to claim 1, further comprising the step of indicating, by reference to the FCD traffic data, the presence of an effective bottleneck which is not conditioned by the route topography, if a pattern of dense traffic has been detected and the average vehicle speed rises again after the pattern of dense traffic is passed, and exceeds an associated predefined threshold value, and the location of the rise in speed lies outside the surrounding area of corresponding recorded route topography features.

6. The method according to claim 1, further comprising the step of indicating the presence of an extensive pattern of dense traffic if the FCD speed profile indicates a region of synchronized traffic or a pinch region extending downstream beyond the location of an effective bottleneck.

7. The method according to claim 1, further comprising the step of determining the location of the boundary ($F_{St,GS}$) between a region of "moving widespread congestion" and a "pinch region" in a pattern of dense traffic by virtue of the fact that the FCD speed profile merges, starting from this location, with a profile in which strong, brief speed reductions alternate with, in comparison, relatively long time periods in which the speed lies in a low speed region.

8. The method according to claim 1, further comprising the step of determining the location of the boundary ($F_{GS,S}$) between a "pinched region" and a region of "synchronized traffic" in a pattern of dense traffic by virtue of the fact that the FCD speed profile merges, starting from this location, with a profile in which the average vehicle speed lies between a predefined minimum speed for synchronized traffic and a predefined minimum speed for freely flowing traffic.

9. The method according to claim 1, further comprising the step of determining the location of the boundary ($F_{p,S}$) between a region of "freely flowing traffic" and a region of "synchronized traffic" of a pattern of dense traffic by virtue of the fact that starting from said location the FCD speed profile merges with a profile in which the speed drops below a predefined minimum speed for freely flowing traffic and remains above a predefined minimum speed value for synchronized traffic.

10. The method according to claim 1, further comprising the step of determining the traffic density ($q^j$) for a respective route edge (j) of the traffic network by reference to a function, predefined differently for the regions of "freely flowing traffic" and "synchronized traffic" and the "pinch region" is determined as a function of travel times ($t_{tr}^{(J)}$) and intervals (DL) which are obtained from the FCD traffic data for FCD vehicles travelling on the respective route edge (j).

11. The method according to claim 1, further comprising the step of determining the traffic density ($q_{in}^{(J)}$) of vehicles travelling into a region of congestion from the difference between the travel times ($Dt_{tr}^{(J)}$) and the difference between the driving times ($Dt^{(J)}$) of FCD vehicles which successively travel along the same route edge (j).

* * * * *